US005228679A

United States Patent [19]

Borostyan

[11] Patent Number: 5,228,679

[45] Date of Patent: Jul. 20, 1993

[54] SHEET DAMPING MECHANISM

[75] Inventor: Stephen M. Borostyan, Penfield, N.Y.

[73] Assignee: Xerox Corporation, Stamford, Conn.

[21] Appl. No.: 511,126

[22] Filed: Apr. 19, 1990

[51] Int. Cl.[5] ..... B65H 31/04; B65H 31/26

[52] U.S. Cl. ..... 271/213; 271/220

[58] Field of Search ..... 271/220, 177, 213, 214, 271/215, 217; 414/791.2, 907; 355/323

[56] References Cited

U.S. PATENT DOCUMENTS

| | | | |
|---|---|---|---|
| 2,660,431 | 11/1953 | Levin | 271/36 |
| 3,949,982 | 4/1976 | Snellman et al. | 271/222 |
| 4,208,122 | 6/1980 | Iwamoto et al. | 355/14 |
| 4,687,193 | 8/1987 | Scarabino et al. | 414/791.2 X |
| 4,687,241 | 8/1987 | Acquaviva | 355/323 |
| 4,824,091 | 4/1989 | Knight | 271/207 X |
| 4,861,015 | 8/1989 | Stearns et al. | 271/220 X |
| 5,056,774 | 10/1991 | Kubota et al. | 271/213 |

OTHER PUBLICATIONS

Ernst, "Copier Skew Reduction", IBM Tech. Bulletin, vol. 23, No. 6, p. 2217, Nov. 1980.

*Primary Examiner*—Robert P. Olszewski
*Assistant Examiner*—Boris Milef
*Attorney, Agent, or Firm*—H. Fleischer; J. E. Beck; R. Zibelli

[57] ABSTRACT

An apparatus which damps movement of sets of sheets being stacked on a support member. The support member moves, at selected intervals, to offset adjacent sets of sheets from one another. A pair of pivotably mounted arms have their free ends engaging the outermost sheet of the sets of sheets stacked on the support member. The arms apply a normal force on the sets of sheets without applying a lateral force thereon. In this way, the sets of sheets are damped without disturbing the integrity of the sets of sheets during offsetting.

8 Claims, 5 Drawing Sheets

SHEET DAMPING MECHANISM

This invention relates generally to an electrophotographic printing machine, and more particularly concerns an apparatus for damping movement of sets of sheets being stacked on a stacking tray for retrieval by an operator.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheets. The copy sheets are collected into unfinished stacks of copy sheets. The collected copy sheets may then be bound or stapled together into finished stacks of copy sheets. Finished or unfinished stacks of copy sheets are then stacked on a stacking tray for presentation to the machine operator.

In a high speed commercial printing machine of the foregoing type, large volumes of finished or unfinished stacks of copy sheets are fed onto the stacking tray. The copy sheets of each stack have their edges aligned. In many applications, it is desirable to have each set of copy sheets offset from one another so that individual sets of copy sheets in the stack may be more easily identified. One type of electrophotographic printing machine that provides this feature is the Xerox Model No. 5090 which automatically offsets each set of collated copy sheets from one another. In printing machines of this type, damping arms contact the uppermost sheets of the sets of copy sheets stacked on the stacking tray. The damping arms move with the stacking tray as the sets of copy sheets are offset from one another. This is accomplished by pivotably mounting the damping arms on a tower mounted on the side of the stacking tray. The damping arms apply a force on each set of copy sheets ejected from the finisher and stacked on the stacking tray to damp any vertical motion of the sets.

Various approaches have been devised for stacking sets of sheets. The following disclosure appears to be relevant:

U.S. Pat. No. 2,660,431, Patentee: Levin, Issued: Nov. 24, 1953.

U.S. Pat. No. 3,949,982, Patentee: Snellman et al., Issued: Apr. 13, 1976.

U.S. Pat. No. 4,208,122, Patentee: Iwamoto et al., Issued: Jan. 17, 1980.

The relevant portions of the foregoing patent may be summarized as follows:

U.S. Pat. No. 2,660,431 discloses a sheet feeder having a tray for supporting a stack of sheets. The tray shifts between feeding of successive sheets or groups of sheets from the stack.

U.S. Pat. No. 3,949,982 describes a pair of arms used to align a stack of sheets. A backstop helps to align the stack laterally. Each arm is pivoted at two points.

U.S. Pat. No. 4,208,122 discloses a stationary tray which receives sets of copy sheets. Adjacent sets of copy sheets are rotated relative to one another by a motor driven claw contacting the uppermost sheet of the set. The claw is rotated by the motor and, in turn, rotates the set of copy sheets that it is in engagement with.

In accordance with one aspect of the present invention, there is provided an apparatus for damping movement of sets of sheets being stacked on a support member. The apparatus includes a substantially stationary frame adapted to guide the sets of sheets onto the support member. Means are provided for moving the support member at selected intervals to offset adjacent sets of sheets from one another. Means, coupled to the frame, apply a force on the sets of sheets with there being no force component substantially parallel to the direction of movement of the support member so as to permit lateral movement of the sets of sheets stacked on the support member without disturbing the integrity of the sets of sheets.

Pursuant to another aspect of the features of the present invention, there is provided an electrophotographic printing machine of the type in which sets of copy sheets reproduced from at least one set of original documents are advanced to a finishing station for finishing and stacking on a support member. The improvement includes a substantially stationary frame adapted to guide the sets of copy sheets onto the support member. Means are provided for moving the support member at selected intervals to offset adjacent sets of copy sheets from one another. Means, coupled to the frame, apply a force on the sets of copy sheets with there being no force component substantially parallel to the direction of movement of the support member so as to permit lateral movement of the sets of copy sheets stacked on the support member without disturbing the integrity of the sets of copy sheets.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
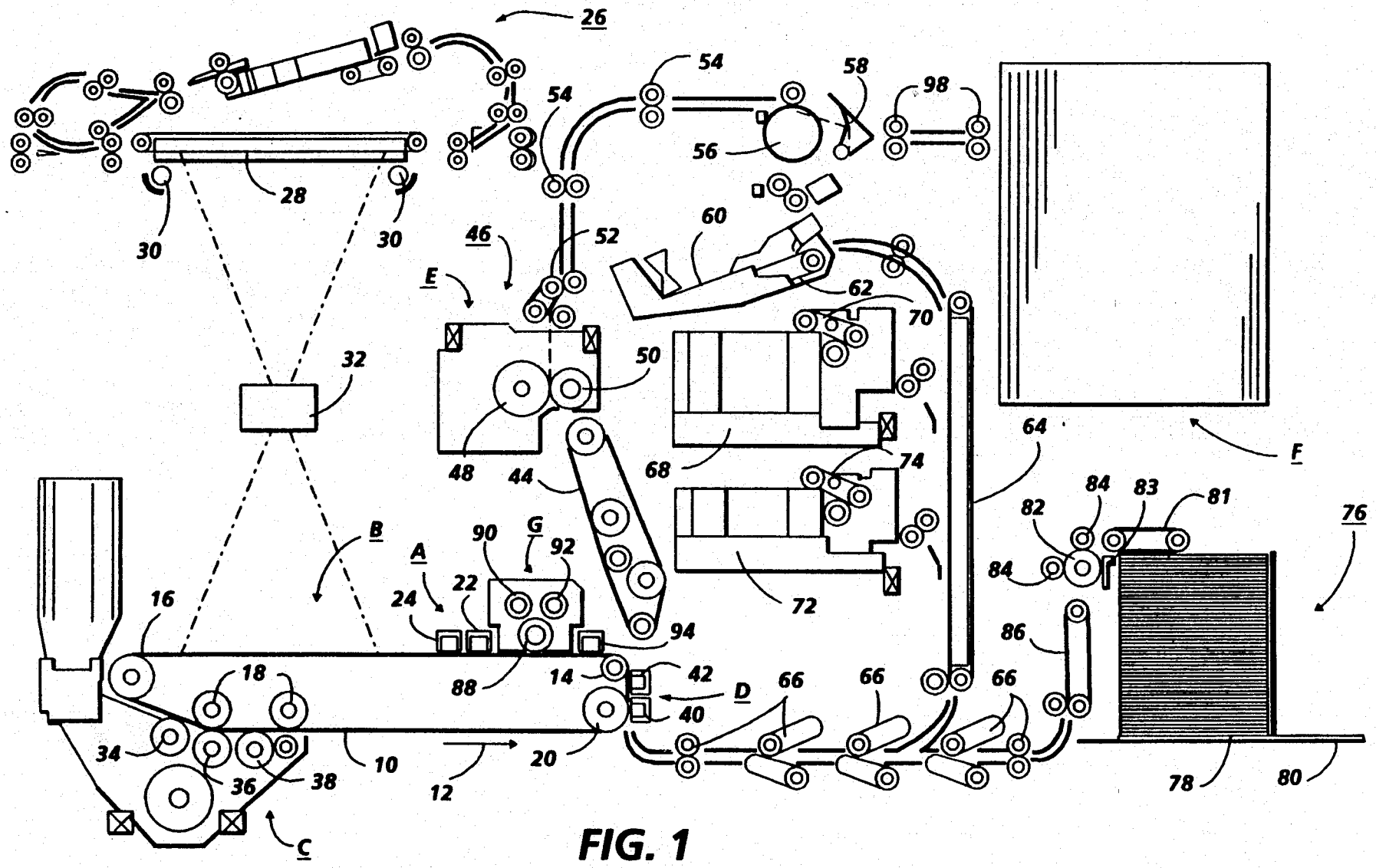
FIG. 1 is a schematic elevational view depicting an illustrative electrophotographic printing machine incorporating a finisher having the apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds original documents from a stack of documents placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the top of the stack of original documents through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. In this way, a plurality of original documents may be sequentially exposed. Thereafter, belt 10 advances the electrostatic latent image recorded thereon to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in compiler trays to form sets of copy sheets. The sets of copy sheets may remain unfinished or may be finished by being attached to one another. The sheets of each set are attached to one another by either a binding device or a stapling device. In either case, a plurality of finished or unfinished sets of copy sheets are formed in finishing station F. The sets of copy sheets are delivered to a stacking tray. Each set of copy sheets may be offset from one another on the stacking tray. The general operation of finishing station F will be described hereinafter with reference to FIG. 2.

With continued reference to FIG. 1, when duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport 86. Transport 86 advances the sheet to rolls 66 which, in turn, move the sheet to transfer station station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the near of cleaning station G.

Figure 3:
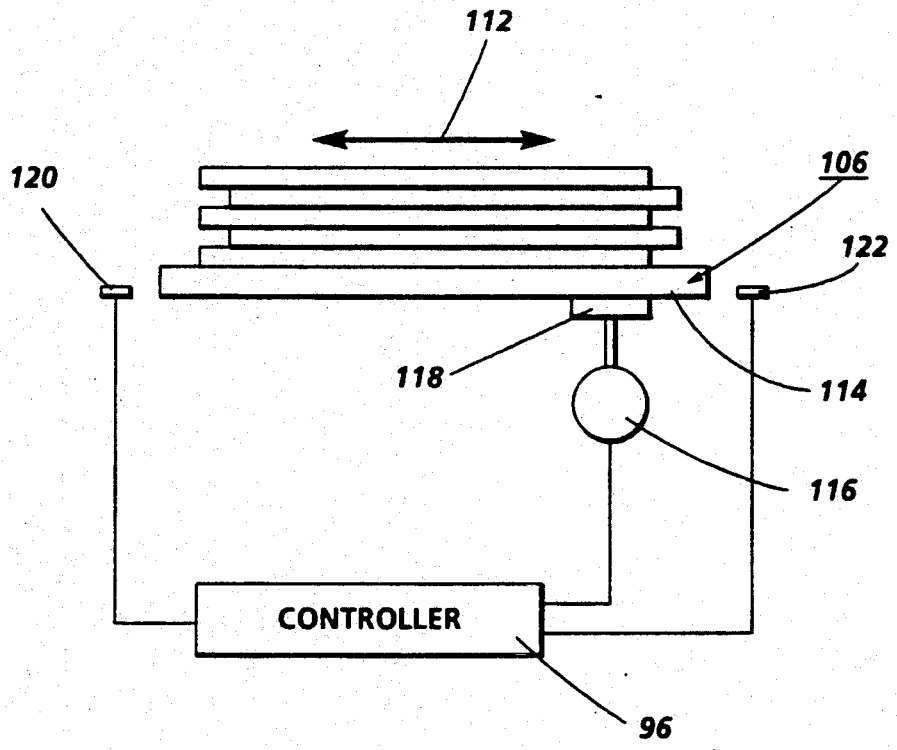
FIG. 3 is a schematic elevational view showing the control system for regulating offsetting of stacks of copy sheets.

The various machine functions are regulated by a controller 96 (FIG. 3). The controller is preferably a programmable microprocessor which controls all of the machine functions hereinabefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected. Further details of the operation of controller 96 for regulating offsetting stacks of copy sheets will be described hereinafter with reference to FIG. 3.

Figure 2:
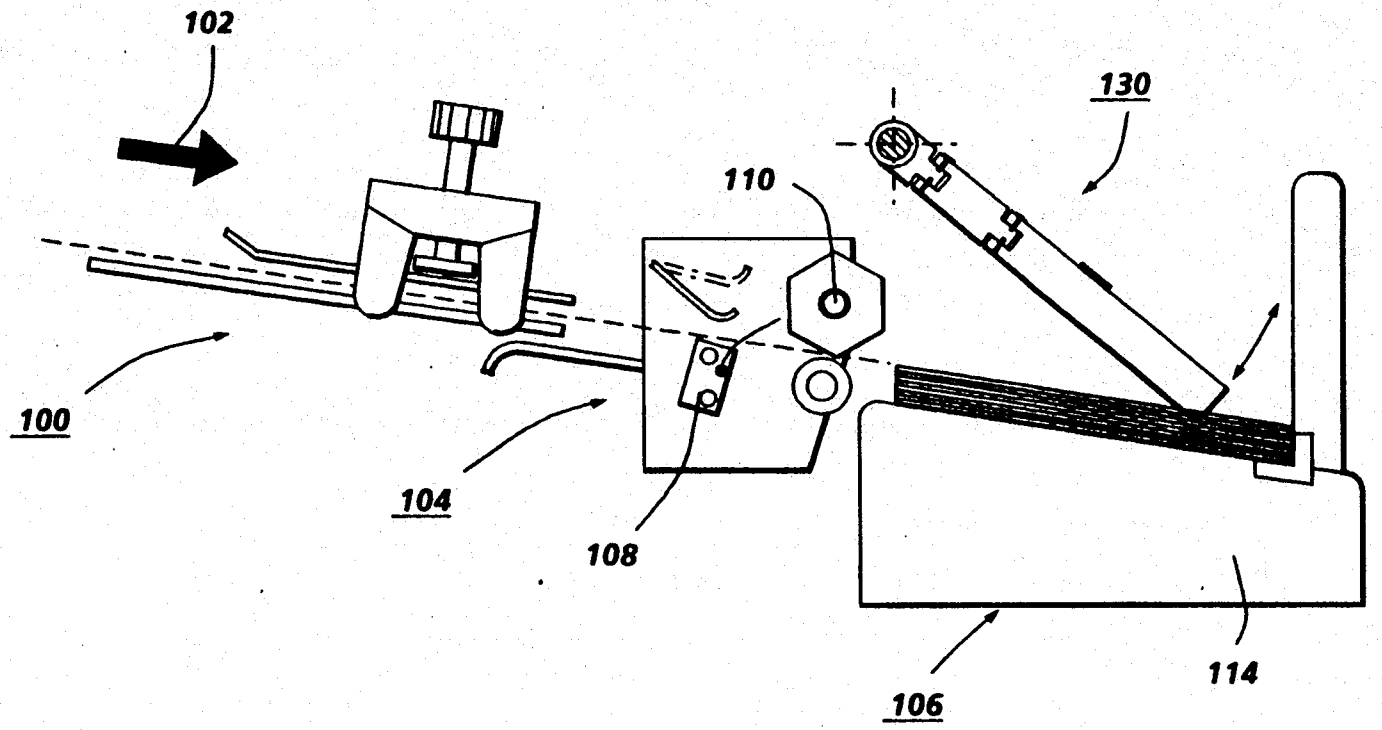
FIG. 2 is a schematic elevational view showing the finishing station of the FIG. 1 printing machine.

Referring now to FIG. 2, the general operation of finishing station F will now be described. Finishing station F receives fused copies from rolls 98 (FIG. 1) and advances them in the direction of arrow 102 to the compiler tray, indicated generally by the reference numeral 100. Compiler tray 100 has two positions, an upper position and a lower position. When the staple option is selected, the compiler tray moves to the upper position in order to compile and be in position to staple the sets of collated copies. Once the stacks of copy sheets are stapled, the compiler tray moves to the lower position. The stapled set of copy sheets is then ejected and the compiler tray raises to the upper position ready to compile the next set of copy sheets for stapling. The lower position is used to compile sets of collated copy sheets that are not being stapled. After the completed set of copy sheets is ejected from the tray, the compiler tray is ready to compile the next set of copy sheets. When the control logic senses that a set of copy sheets is complete, the set of copy sheets is ready to leave compiler tray 100. The set of copy sheets is ejected into the output transport assembly, indicated generally by the reference numeral 104, which drives the set of copy sheets out of complier tray 100 into a stacker, indicated generally by the reference numeral 106. Output switch 108 senses each set of copy sheets as it leaves compiler tray 100. Output switch 108 informs the controller if a jam occurs. If a jam does occur, the controller then declares a fault code. Sets of copy sheets can range in thickness from about two sheets to one hundred sheets. Because of the wide range of sheet sizes and the varying thicknesses of the sets of copy sheets, hexagonal shaped foam rolls 110 are used to provide a uniform nip force to drive the stacks of copy sheets to stacker 106. The damping mechanism of the present invention, indicated generally by the reference numeral 130 has the free end thereof contacting the uppermost sheet of the sets of copy sheets supported by tray 114 of stacker 106. FIGS. 4 through 7, inclusive, discuss damping mechanism 130 in greater detail.

FIG. 3 shows the apparatus for controlling offsetting stacks of copy sheets from one another. Stacker 106 includes a tray 114. Tray 114 is moved to its' two offset positions by an AC motor 116 coupled to a surface cam 118. Cam 118 has a groove that a pin attached to the lower portion of tray 114 follows when motor 116 rotates cam 118. This groove translates the motors rotational movement into forward or reverse movement depending upon the direction that motor 116 is commanded to rotate. Guide pins in slots on the lower portion of tray 114 allow forward or reverse movement of the tray while maintaining the height and width of the tray. Switches 120 and 122, when actuated, signal to controller 96 that the tray is in the forward or reverse position. The controller, in turn, signals to stop forward or reverse movement. In this way, while stacks of copy sheets are being loaded onto the tray, the tray alternately offsets adjacent stacks of copy sheets about 35 millimeters.

Figure 4:
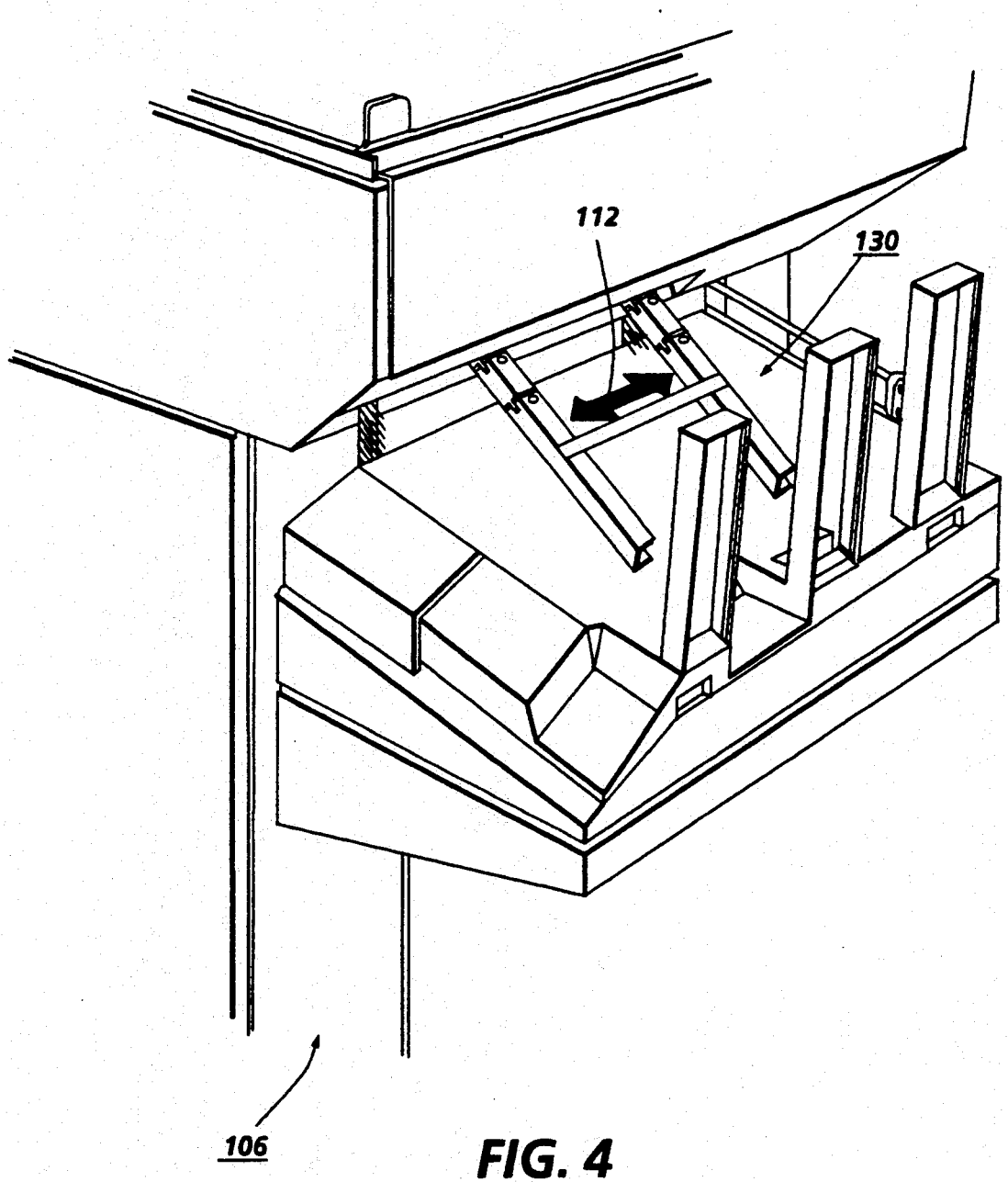
FIG. 4 is a fragmentary, perspective view illustrating the stacking tray for supporting sets of finished copy sheets with the damping mechanism of the present invention.

Turning now to FIG. 4, stacker 106 receives the stacks of copy sheets from compiler tray 100. Stacker 106 adjusts to the size and quantity of the selected job by moving in the vertical direction and the width wise direction. Stacker width movement occurs at the start of any job that has the finisher selected. The controller senses the size of the copy sheet that is in the selected copy sheet tray of the printing machine. A motor moves the stacker tray to the appropriate width. Vertical movement of the stacker ensures that each set of copy sheets being delivered to the stacker does so at the same angle. A motor will continue to lower the stacker tray so that the top of the set stays a specific distance from the set exit point. The controller senses when the sets of copy sheets have been removed and will raise the stacker tray to the highest position. Thus, a plurality of sets of copy sheets may be stacked on the tray of stacker 106. When more than one set of copy sheets is being made, the stacker may offset adjacent sets of copy sheets from one another by moving in the direction of arrows 112 between successive stacks of copy sheets.

Figure 5:
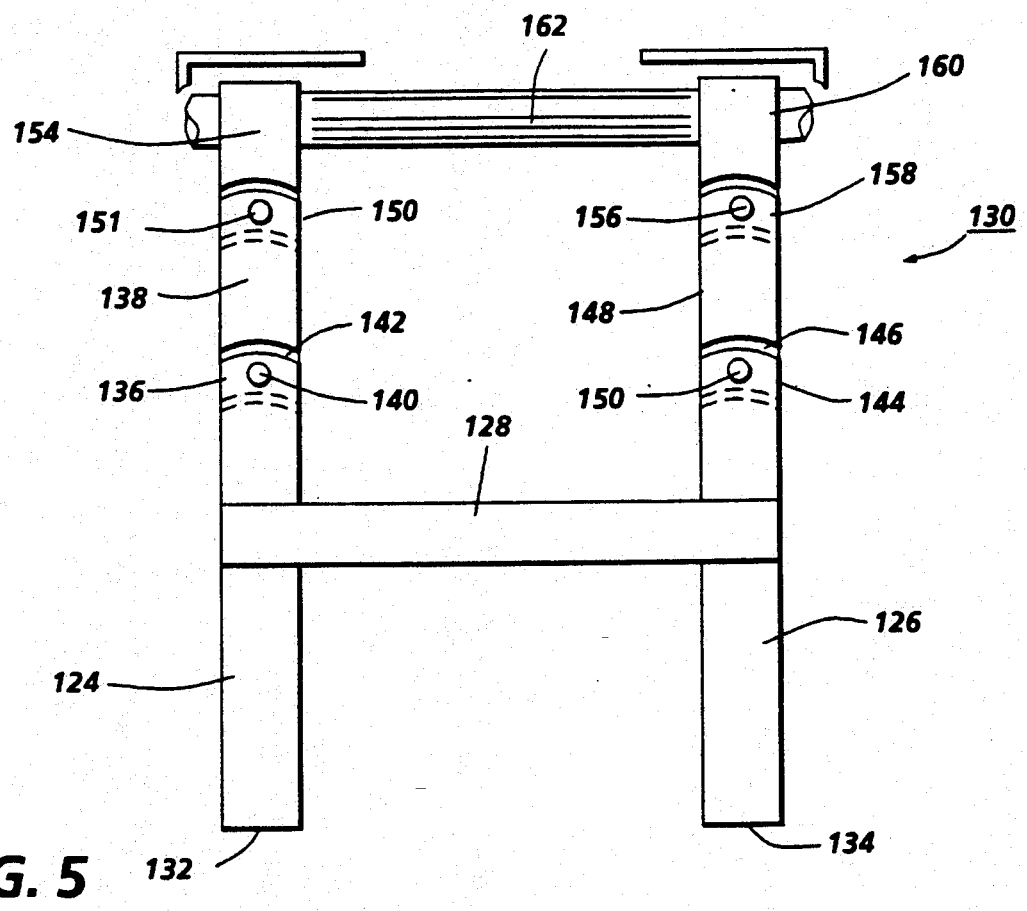
FIG. 5 shows the FIG. 4 damping mechanism in greater detail.
Figure 6:
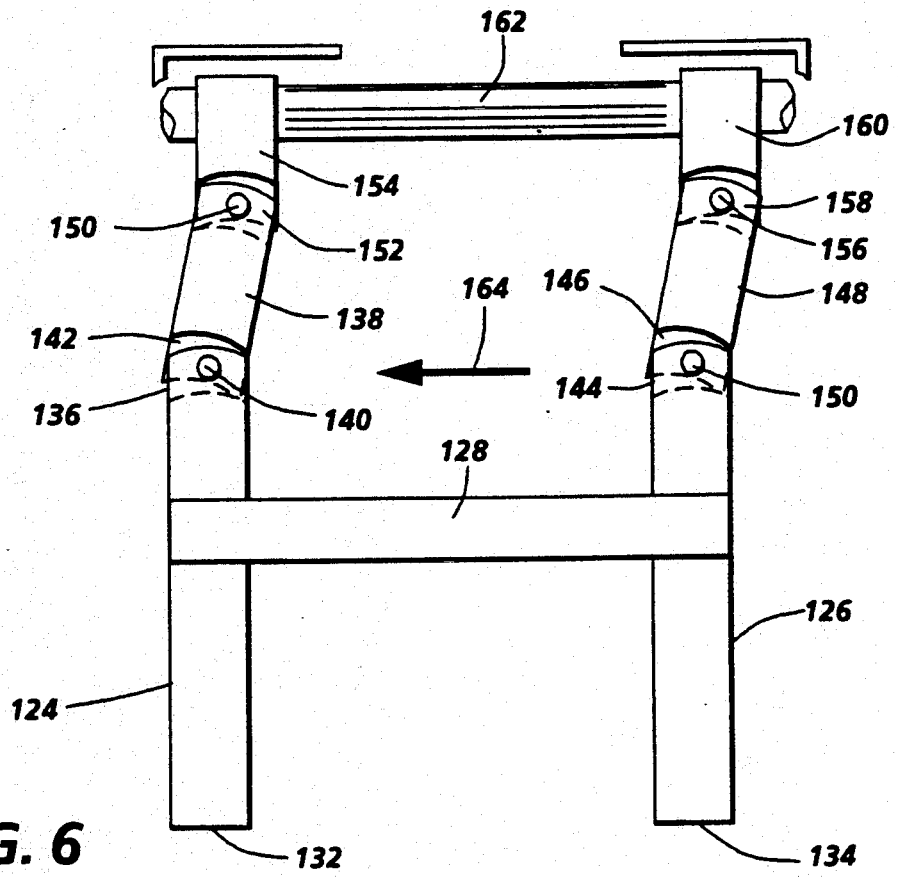
FIG. 6 shows the FIG. 6 damping mechanism moving laterally.

Referring now to FIGS. 5 and 6, damping mechanism 130 includes a pair of elongated arms 124 and 126. Arm 124 is spaced from arm 126. Cross bar 128 connects arm 124 to arm 126. Arms 124 and 126 are attached to one another by cross bar 128 so as to be substantially parallel to one another. Free end 132 of arm 124 contacts the uppermost sheet of the sets of sheets on tray 114. Similarly, free end 134 of arm 126 contacts the uppermost sheet of the sets of sheets on tray 114. End 136 of arm 124 is secured pivotably to end 142 of link 138. Pin 140 pivotably connects arm 124 to link 138. In a similar manner, end 144 of arm 126 is secured pivotably to end 146 of link 148. Pin 150 pivotably connects arm 126 to link 148. Pin 151 pivotably connects end 152 of link 138 to coupling 154. Pin 156 pivotably connects end 158 of link 148 to coupling 160. Couplings 154 and 160 are mounted pivotably on a rod 162 secured fixedly to the frame of the finishing station of the printing machine. In this way, arms 124 and 126 can pivot about rod 162 so that the free ends thereof, 132 and 134, continually rest on the uppermost sheet of the sets of sheets on tray 114 as the height of the stack of sets of copy sheets varies and the vertical position of tray 114 changes. furthermore, as tray 114 shifts laterally to offset the sets of copy sheets from one another, arms 124 and arms 126 shift therewith without applying a lateral force on the sets of copy sheets. This is more clearly illustrated in FIG. 6. As shown thereat, tray 114 shifts in the direction of arrow 164. The frictional force exerted by the sets of copy sheets on the free ends 132 and 134 of arms 124 and 126, respectively, pivots arms 124 and 126 about pins 140 and 150, respectively. Links 138 and 148, in turn, pivot about pins 151 and 156, respectively. In this way, arms 124 and 126 move in the direction of arrow 164, while remaining parallel to one another without applying a lateral force, i.e. a force parallel to arrow 164 on the sets of copy sheets. This insures that the integrity of the sets of copy sheets on tray 114 remain undisturbed as tray 114 moves laterally to offset successive sets of copy sheets from one another. The force components applied by arms 124 and 126 on the sets of copy sheets is more clearly illustrated in FIG. 7.

Figure 7:
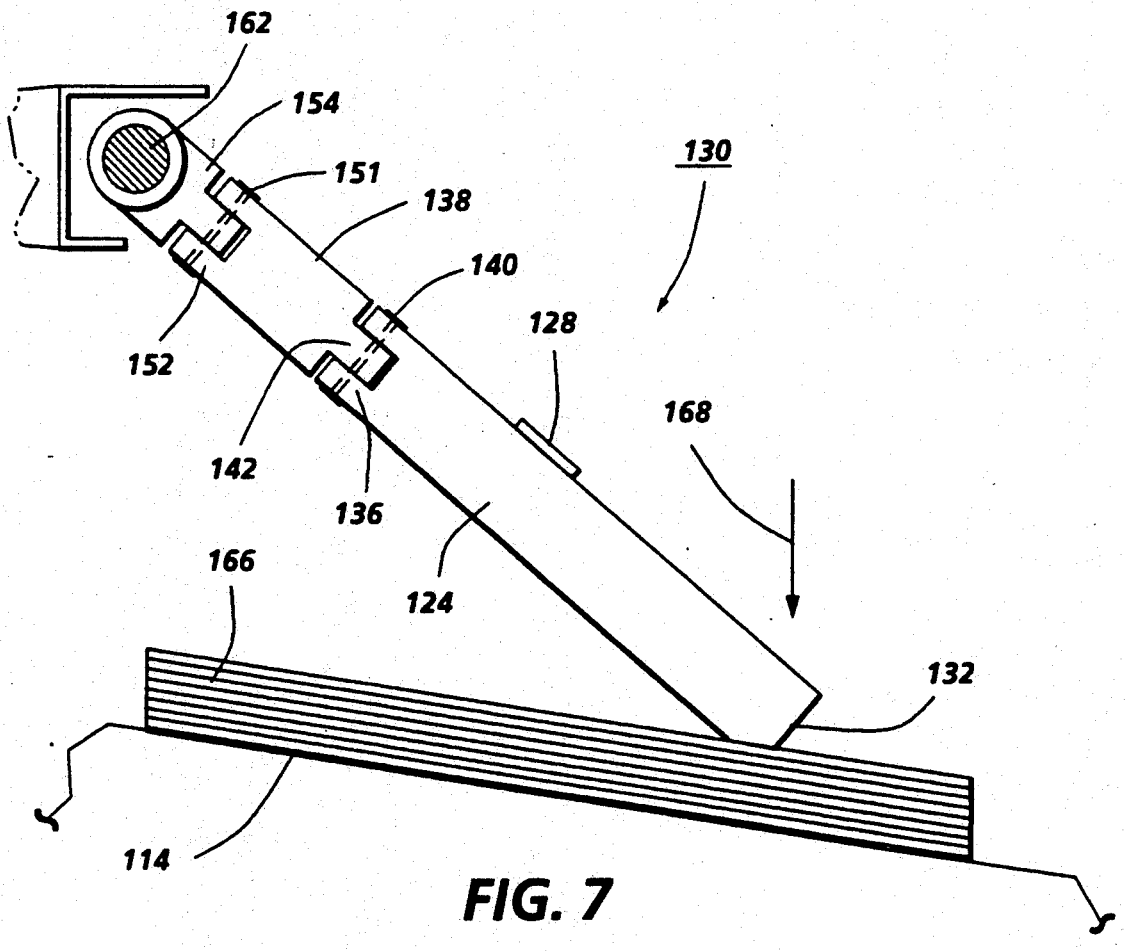
FIG. 7 illustrates the force exerted by the FIG. 6 damping mechanism on the sets of copy sheets stacked on the stacking tray.

FIG. 7 is a side elevational view of damping mechanism 130. Since the force applied by arm 126 on the sets of copy sheets stacked on tray 114 is substantially identical to that applied by arm 124, only the force applied by arm 124 will be described with reference to FIG. 7. As shown therein, free end 132 of arm 124 rests against the uppermost sheet of the stack 166 of sets of copy sheets on tray 114. Arm 124 applies a force 168 in a vertical direction with no lateral or component in the direction movement of the sets of copy sheets as they are offset from one another. Since the arms are always parallel to one another and to the incoming sets of copy sheets, no lateral force is applied to the sets of copy sheets. In this way, there is no lateral force component developed for disturbing the integrity of the sets of copy sheets stacked on tray 114.

In recapitulation, the apparatus of the present invention damps the movement of sets of copy sheets stacked on a tray without applying a lateral force on the sets as sets are positioned on the tray, and the tray offsets successive sets of copy sheets from one another. This is achieved by employing a pair of arms connected in parallel to one another and mounted pivotably on the finishing station frame. A double pivot connects each arm to the frame. In this way, the arms pivot about the frame and remain parallel to one another and the incoming sets of copy sheets so as to only apply a normal force on the sets of copy sheets damping movement thereof without applying a lateral force thereon. This insures that the integrity of the stack sets of copy sheets remains undisturbed as the tray moves to offset successive sets of copy sheets from one another.

It is, therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for damping movement of sets of sheets being stacked on a support member, including:

a substantially stationary frame adapted to guide the sets of sheets onto the support member;

means for moving said support member at selected intervals to offset adjacent sets of sheets from one another; and means, coupled to said frame, for applying a force on the sets of sheets having a component substantially normal to the sets of sheets stacked on the support member with no force component other than a frictional force between said applying means and the sets of sheets being substantially parallel to the direction of movement of the support member to move said applying means in substantially unison with the sets of sheets in the lateral direction so as to permit lateral movement of the sets of sheets stacked on the support member without disturbing the integrity of the sets of sheets, said applying means comprises a first arm having one end thereof contacting the outermost sheet of the sets of sheets on the support member; a second arm spaced from said first arm having one end thereof contacting the outermost sheet of the sets of sheets on the support member; means for pivotably connecting said first arm and said second arm to said frame, said connecting means comprises a first length having one end thereof pivotably connected to the other end of said first arm with the other end of said link being pivotably connected to said frame; and a second link having one end thereof pivotably connected to the other end of said second arm with the other end of said second link being pivotably connected to said frame, and means for attaching said first arm to said second arm with said first arm being substantially parallel to said second arm.

2. An apparatus according to claim 1, wherein:

said first link pivots about an axis on said frame substantially parallel to the axis on said first link that said first arm pivots about; and said second link pivots about an axis on said frame substantially parallel to the axis on said second link that said second arm pivots about.

3. An apparatus according to claim 2, wherein;

said first link pivots about an axis on said frame substantially perpendicular to the axis on said first link that said first arm pivots about; and said second link pivots about an axis on said frame substantially perpendicular to the axis on said second link that said second arm pivots about.

4. An apparatus according to claim 3, wherein said attaching means includes a bar having one end secured to said first arm and the other end thereof secured to said second arm.

5. An electrophotographic printing machine of the type in which sets of copy sheets reproduce from at least one set of original documents are advanced to a finishing station for finishing and stacking on a support member, wherein the improvement includes:

a substantially stationary frame adapted to guide the sets of sheets onto the support member;

means for moving said support member at selected intervals to offset adjacent sets of copy sheets from one another; and means, coupled to said frame, for applying a force on the sets of copy sheets having a component substantially normal to the sets of sheets stacked on the support member with no force component other than a frictional force between said applying means and the sets of copy sheets being substantially parallel to the direction of movement of said support member to move said applying means in substantial unison with the sets of sheets in the lateral direction so as to permit lateral movement of the sets of copy sheets stacked on the support member without disturbing the integrity of the sets of copy sheets, said applying means comprises a first arm having one end thereof contacting the outermost sheets of the sets of sheets on the support member, a second arm, spaced from said first arm, having one end thereof contacting the outermost sheet of the sets of sheets on the support member, a second arm, spaced from said first arm, having one end thereof contacting the outermost sheet of the sets of sheets on the support member, means for pivotably connecting said first arm and said second arm to said frame, said connecting means comprises a first link having one end thereof pivotably connected to the other end of said first arm with the other end of said first link being pivotably connected to said frame, and a second link having one end thereof pivotably connected to the other end of said second arm with the other end of said second link being pivotably connected to said frame, and means for attaching said first arm to said second arm with said first arm being substantially parallel to said second arm.

6. A printing machine according to claim 5, wherein:

said first link pivots about an axis on said frame substantially parallel to the axis on said first link that said first arm pivots about; and said second link pivots about an axis on said frame substantially parallel to the axis on said second link that said second arm pivots about.

7. A printing machine according to claim 6, wherein;

said first link pivots about an axis on said frame substantially perpendicular to the axis on said first link that said first arm pivots about; and said second link pivots about an axis on said frame substantially perpendicular to the axis on said second link that said second arm pivots about.

8. A printing machine according to claim 7, wherein said attaching means includes a bar having one end secured to said first arm and the other end thereof secured to said second arm.

* * * * *